US011084994B2

(12) United States Patent
Egolf et al.

(10) Patent No.: US 11,084,994 B2
(45) Date of Patent: Aug. 10, 2021

(54) REFORMING PROCESS WITH IMPROVED HEATER INTEGRATION

(71) Applicant: UOP LLC, Des Plaines, IL (US)

(72) Inventors: Bryan J. Egolf, Crystal Lake, IL (US); Charles Brabson, Humble, TX (US); William M. Hartman, Des Plaines, IL (US); William Yanez, Crystal Lake, IL (US); Matthew Martin, Tulsa, OK (US); Ka Lok, Buffalo Grove, IL (US)

(73) Assignee: UOP LLC, Des Plaines, IL (US)

( * ) Notice: Subject to any disclaimer, the term of this patent is extended or adjusted under 35 U.S.C. 154(b) by 3 days.

(21) Appl. No.: 15/587,959

(22) Filed: May 5, 2017

(65) Prior Publication Data

US 2017/0327755 A1 Nov. 16, 2017

Related U.S. Application Data

(60) Provisional application No. 62/336,349, filed on May 13, 2016.

(51) Int. Cl.
*C10G 69/08* (2006.01)
*C10G 69/00* (2006.01)

(52) U.S. Cl.
CPC ..... *C10G 69/08* (2013.01); *C10G 69/00* (2013.01); *C10G 2300/4006* (2013.01)

(58) Field of Classification Search
CPC ..... C10G 69/00; C10G 69/08; C10G 2300/4006; C10G 63/00; C10G 9/38
See application file for complete search history.

(56) References Cited

U.S. PATENT DOCUMENTS

| | | | | |
|---|---|---|---|---|
| 2,547,221 | A * | 4/1951 | Layng | B01J 23/16 208/136 |
| 5,879,537 | A | 3/1999 | Peters | |
| 8,197,250 | B2 | 6/2012 | Morgan et al. | |
| 9,206,358 | B2 | 12/2015 | Hartman et al. | |
| 9,296,958 | B2 | 3/2016 | Wen et al. | |
| 2004/0004022 | A1 | 1/2004 | Stell et al. | |

(Continued)

FOREIGN PATENT DOCUMENTS

| | | | |
|---|---|---|---|
| CN | 105073955 A | 11/2015 | |
| EP | 0200825 * | 11/1986 | C01B 3/382 |

(Continued)

OTHER PUBLICATIONS

Garg, How to boost the performance of fired heaters, Nov. 1989, Chemical Engineering, pp. 239-244, <heatflux.com>. (Year: 1989).*

(Continued)

*Primary Examiner* — Michelle Stein

(57) ABSTRACT

A method and apparatus for processing a hydrocarbon stream are described. The method includes heating a feed stream in a convective bank. The heated feed stream is reacted in a first reaction zone to form a first effluent, which is heated in a first radiant cell. The first radiant cell combusts fuel to heat the first effluent and forms a first exhaust gas. The first exhaust gas is contacted with the convective bank to heat the feed stream. The outlet temperature the heated feed stream from the convective bank is controlled by introducing an additional gas stream into the convective bank. There can be additional reaction zones and radiant heaters.

19 Claims, 2 Drawing Sheets

(56) References Cited

U.S. PATENT DOCUMENTS

| | | | | |
|---|---|---|---|---|
| 2004/0089588 | A1 | 5/2004 | Garg | |
| 2005/0209495 | A1* | 9/2005 | McCoy | C10G 9/20 585/648 |
| 2005/0261534 | A1 | 11/2005 | Stell et al. | |
| 2005/0261536 | A1 | 11/2005 | Stell et al. | |
| 2008/0110801 | A1 | 5/2008 | Yuan et al. | |
| 2014/0251868 | A1 | 9/2014 | Wen et al. | |
| 2014/0291205 | A1* | 10/2014 | Hartman | C10G 9/20 208/64 |
| 2015/0027053 | A1 | 1/2015 | Lin et al. | |
| 2015/0060034 | A1 | 3/2015 | Pandya et al. | |

FOREIGN PATENT DOCUMENTS

| | | | |
|---|---|---|---|
| EP | 1765958 | | 12/2005 |
| RU | 2110554 | C1 | 5/1998 |
| WO | 2005113713 | A2 | 12/2005 |

OTHER PUBLICATIONS

Search Report dated Aug. 31, 2017 for corresponding PCT Appl. No. PCT/US2017/030957.

International Preliminary Report on Patentability from corresponding PCT application No. PCT/US2017/030957, dated Nov. 13, 2018.

Written Opinion from corresponding PCT application No. PCT/US2017/030957, dated Jul. 3, 2017.

International Search report from corresponding PCT application No. PCT/US2017/030957, dated Aug. 31, 2017.

Extended European Search Report from corresponding European application No. 17796586.0, dated Nov. 7, 2019.

* cited by examiner

REFORMING PROCESS WITH IMPROVED HEATER INTEGRATION

CROSS-REFERENCE TO RELATED APPLICATION

This application claims priority from Provisional Application No. 62/336,349 filed May 13, 2016, the contents of which cited application are hereby incorporated by reference in its entirety.

BACKGROUND OF THE INVENTION

Hydrocarbon conversion processes often employ a series of reaction zones through which hydrocarbons pass. Each reaction zone may have its own unique process requirements, including a required temperature. Accordingly, each reaction zone requires a sufficient amount of heating upstream of the reaction zone to achieve the required temperature for performing the desired hydrocarbon conversion therein.

One well-known hydrocarbon conversion process is catalytic reforming. Catalytic reforming is a well-established hydrocarbon conversion process employed in the petroleum refining industry for improving the octane quality of hydrocarbon feed streams. The primary product of catalytic reforming is a gasoline blending component or a source of aromatics for petrochemicals. Reforming may be defined as the total effect produced by dehydrogenation of cyclohexanes and dehydroisomerization of alkylcyclopentanes and high carbon content $C_6$ to $C_7$ naphthenes to yield aromatics, dehydrogenation of paraffins to yield olefins, dehydrocyclization of paraffins and olefins to yield aromatics, isomerization of n-paraffins, isomerization of alkylcycloparaffins to yield cyclohexanes, isomerization of substituted aromatics, and hydrocracking of paraffins. A reforming feed stream can be a product stream from a hydrocracker, a fluid catalytic cracker (FCC), or a coker, or a straight run naphtha feed, and can contain many other components such as a condensate or a thermal cracked naphtha.

Heaters or furnaces are often used in hydrocarbon conversion processes, such as reforming, to heat the process fluid before it is reacted. Generally, fired heaters or furnaces include a radiant fired heating zone to heat the fluid, with a convective section being used for another service, such as producing steam. Each section includes tubes to contain the process fluid flowing through the heater. The U-tube fired heater assembly is an expensive mainstay of catalytic reforming. This design combines several key advantages, including: (a) a low coil pressure drop, (b) flexibility in duty specifications between cells, (c) ability to integrate multiple cells with a common heat recovery system, and (d) turndown control that protects downstream plate-type exchanger from sudden temperature changes.

Typical reforming process designs have developed duty specifications for the multiple fired heater cells in order to provide the same inlet temperature to each reaction stage.

However, in view of the rising costs of fuel, conventional designs suffer disadvantages. Specifically, the production of steam by convective sections is non-optimal as steam is provided in other areas of hydrocarbon processing plants. Rather, heat from the fuel combusted in the radiant fired heating zone can be better concentrated on an increase in enthalpy in hydrocarbon processing.

Accordingly, methods for processing hydrocarbons utilizing convective sections to heat hydrocarbon streams have been developed. For example, U.S. Pat. No. 9,206,358 describes a method for heating a feed stream in a convective bank. The feed stream is reacted in a first reaction zone to form a first effluent. The first effluent is heated is a first radiant cell that combusts fuel gas to heat the first effluent and forms a first exhaust gas. The method include contacting first exhaust gas with the convective bank to heat the feed stream. However, this process does not permit effective temperature control for the charge heater discharge temperature, resulting in under-utilization of first reactor process yield.

Therefore, there is a need for methods of processing hydrocarbons using convective sections to heat hydrocarbon streams which provide temperature control for the charge heater discharge temperature.

SUMMARY OF THE INVENTION

Figure 1:
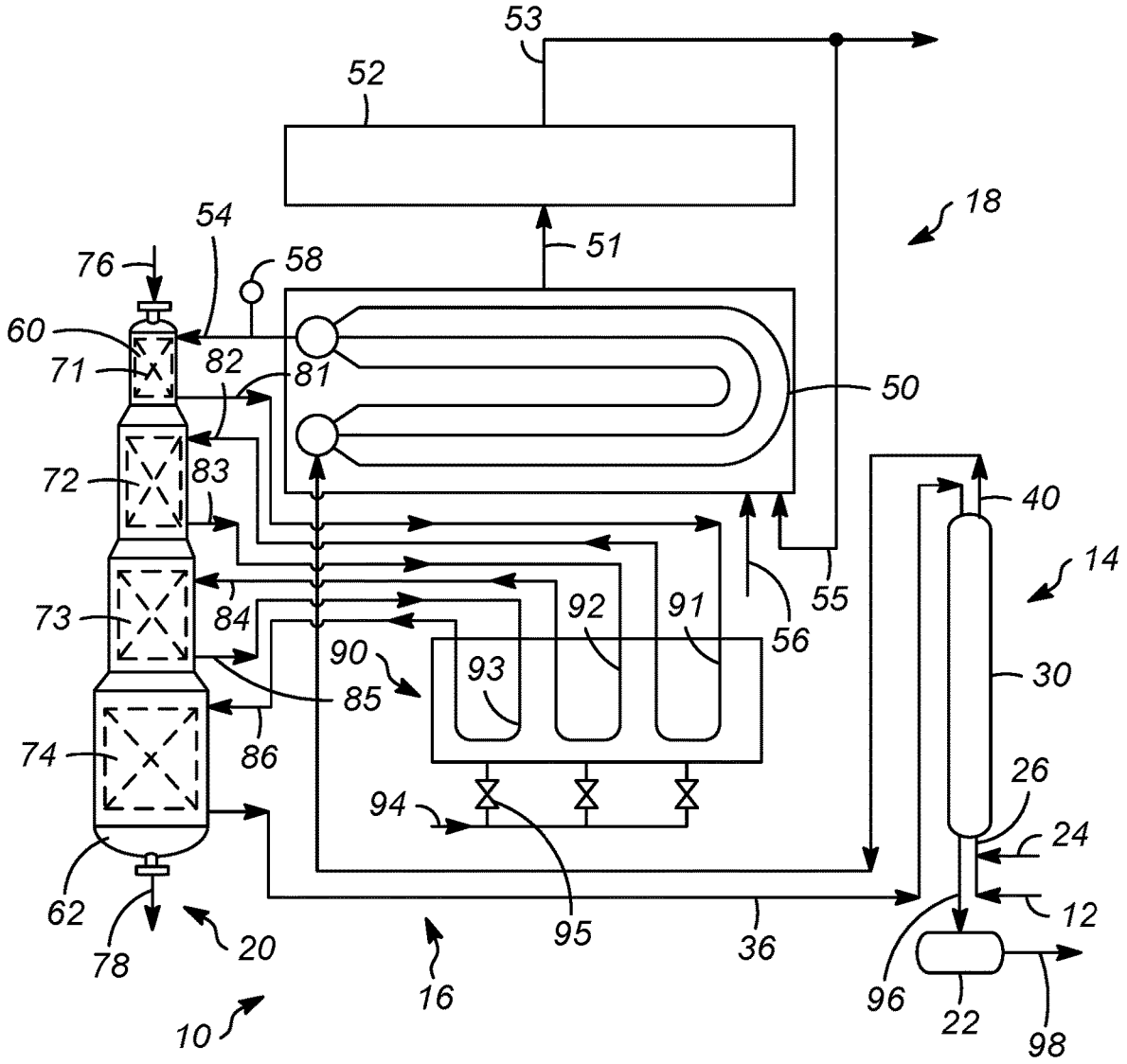
FIG. 1 is an illustration of one embodiment of a method and apparatus for heating a feed stream according to the present invention.

One aspect of the invention is a method for processing a hydrocarbon stream. In one embodiment, the method includes heating a feed stream in a convective bank. The heated feed stream is reacted in a first reaction zone to form a first effluent, and the first effluent is heated in a first radiant cell. The first radiant cell combusts fuel to heat the first effluent and forms a first exhaust gas. The first exhaust gas is contacted with the convective bank to heat the feed stream. The outlet temperature the heated feed stream from the convective bank is controlled by introducing an additional gas stream into the convective bank.

Another aspect of the invention is an apparatus for processing a hydrocarbon stream. In one embodiment, the apparatus comprises a heat exchanger configured to heat a feed stream. There is a convective bank configured to receive the feed stream and an additional gas stream. There is a reaction zone configured to receive a heated feed stream from the convective bank and to react the heated feed stream to form an effluent. There is a radiant cell configured to receive and heat the effluent; the radiant cell forms an exhaust gas, and is configured to pass a portion of the exhaust gas to the convective bank to heat the feed stream. A temperature sensor is configured to monitor a temperature of the heated feed stream exiting the convective bank. There is a flow controller configured to change an amount of the portion of the exhaust gas flowing to the convective bank in response to the temperature of the heated feed stream exiting the convective bank.

DETAILED DESCRIPTION OF THE INVENTION

Significant cost and plot space reductions in the heater assembly can be obtained when heater duty requirements are considered within selecting catalytic inlet temperatures. By providing a lower inlet temperature to the first reaction stage, the charge heater radiant cell can be relocated into the heat recovery section of the heater assembly. Control over the inlet temperature of the first reactor is achieved by tempering the flue gas inlet temperature to the heat recovery system. The overall process efficiency is improved, leading to a reduction in the fuel firing requirements of about 15% to about 30%, and resulting in about a 10% to about 25% reduction in the cost of the fired heater assembly.

The invention involves controlling the temperature of the outlet stream from the convective bank by introducing an additional gas stream into the convective bank. The additional stream can be fresh gas, a portion of the exhaust gas from the convective bank, or both. The temperature of the additional gas can be controlled; the additional gas can be heated or cooled if necessary. Alternatively or in addition, the blend of the fresh gas and the exhaust gas can be varied.

Methods and apparatus for processing hydrocarbon streams, and more particularly, for heating hydrocarbon streams in convective sections upstream of reaction zones are provided. The methods and apparatus reduce fuel costs for radiant fired heating zones, as increased amounts of energy produced from combustion of the fuel is transferred to the hydrocarbon streams through convective sections. The methods and apparatus provide effective temperature control of the inlet temperature of the first reactor.

As used herein, the phrase "hydrocarbon stream" includes any stream including various hydrocarbon molecules, such as straight-chain, branched, or cyclic alkanes, alkenes, alkadienes, and alkynes, and optionally other substances including gases, such as hydrogen. The hydrocarbon stream may be subject to reactions, for example, reforming reactions, but still may be referred to as a hydrocarbon stream, as long as at least some hydrocarbons are present in the stream after the reaction. Thus, the hydrocarbon stream may include streams that are subjected to one or more reactions, e.g., a hydrocarbon stream effluent, or not subjected to any reactions, e.g., a naphtha feed. As used herein, a hydrocarbon stream can also include a raw hydrocarbon feed stream, a combined feed stream, or an effluent.

The methods and apparatus for heating hydrocarbons for processing as described herein are particularly applicable to processes utilizing at least two reaction zones, where at least a portion of the hydrocarbon stream flows serially through the reaction zones. Processes having multiple reaction zones may include a wide variety of hydrocarbon conversion processes such as reforming, hydrogenation, hydrotreating, dehydrogenation, isomerization, dehydroisomerization, dehydrocyclization, cracking, and hydrocracking processes. Catalytic reforming often utilizes multiple reaction zones, and will be referenced hereinafter in the embodiments depicted in the drawings. However, the claimed methods and apparatus are not limited for catalytic reforming processes.

The drawings illustrate an embodiment of a method and apparatus for hydrocarbon processing as applied to a catalytic reforming process. The drawings are presented solely for purposes of illustration and are not intended to limit the scope of the claims as set forth below. The drawings show only the equipment and lines necessary for an understanding of various embodiments herein and do not show equipment such as pumps, compressors, heat exchangers, and valves which are not necessary for an understanding of the methods and apparatus claimed herein and which are well known to persons of ordinary skill in the art of hydrocarbon processing.

Referring to FIG. 1, an apparatus 10 for processing a hydrocarbon feed stream 12 is schematically depicted. The exemplary apparatus 10 is a reforming unit including a heat exchange section 14, a radiant fired heating section 16, a convective heating section 18, a reaction section 20, and a product recovery section 22.

As shown, the hydrocarbon feed stream 12 flows to the heat exchange section 14 upstream of sections 16, 18 and 20. An exemplary hydrocarbon feed stream 12 for catalytic reforming is a petroleum fraction known as naphtha, having an initial boiling point of about 82° (about 180° F.) and an end boiling point of about 203° C. (about 400° F.). The catalytic reforming process is particularly applicable to the treatment of straight run naphthas comprised of relatively large concentrations of naphthenic and substantially straight chain paraffinic hydrocarbons, which are subject to aromatization through dehydrogenation and/or cyclization reactions. Exemplary charge stocks are naphthas consisting principally of naphthenes and paraffins that can boil within the gasoline range, although, in many cases, aromatics also can be present. This class of naphthas includes straight-run gasolines, natural gasolines, synthetic gasolines, and the like. Other embodiments may charge thermally or catalytically cracked gasolines or partially reformed naphthas. Mixtures of straight-run and cracked gasoline-range naphthas can also be used to advantage. The gasoline-range naphtha charge stock may be a full-boiling gasoline having an initial boiling point of about 40° C. to about 82° C. (about 104° F. to about 180° F.) and an end boiling point within the range of about 160° C. to about 220° C. (about 320° F. to about 428° F.), or may be a selected fraction thereof which generally can be a higher-boiling fraction commonly referred to as a heavy naphtha, for example, a naphtha boiling in the range of about 100° C. to about 200° C. (about 212° F. to about 392° F.). In some cases, it is also advantageous to charge pure hydrocarbons or mixtures of hydrocarbons that have been recovered from extraction units, for example, raffinates from aromatics extraction or straight-chain paraffins, which are to be converted to aromatics. In some other cases, the feed stream 12 may also contain light hydrocarbons that have 1-5 carbon atoms, but since these light hydrocarbons cannot be readily reformed into aromatic hydrocarbons, these light hydrocarbons entering with the feed stream 12 are generally minimized.

As is typical for catalytic reforming processes, the feed stream 12 is admixed with a recycled stream 24 comprising hydrogen to form what is commonly referred to as a combined feed stream 26 before being delivered to a combined feed heat exchanger 30 in the heat exchange section 14. Generally, the recycled stream 24 supplies hydrogen in an amount of about 1 to about 20 moles of hydrogen per mole of hydrocarbon feed stream 12. For example, hydrogen may be supplied to provide an amount of less than about 3.5 moles of hydrogen per mole of hydrocarbon feed stream 12. If hydrogen is supplied, it may be supplied upstream of the combined feed heat exchanger 30, downstream of the combined feed heat exchanger 30, or both upstream and downstream of the combined feed heat exchanger 30. Alternatively, no hydrogen may be supplied. Even if hydrogen is not provided to the hydrocarbon feed stream 12, naphthene reforming reactions that occur within the reaction section 20 can yield hydrogen as a by-product. This by-product, or in-situ-produced, hydrogen can become available as hydrogen downstream reaction zones within the reaction section 20. In situ hydrogen in the reaction section 20 may total from about 0.5 to about 2 moles of hydrogen per mole of hydrocarbon feed stream 12.

In the combined feed heat exchanger 30, the combined feed stream 26 can be heated by exchanging heat with the product effluent 36 of the reaction section 20. However, the heating of the combined feed stream 26 that occurs in the combined feed heat exchanger 30 is generally insufficient to heat the combined feed stream 26 to the desired inlet temperature of the reaction section 20. In a typical catalytic reforming process, the combined feed stream 26, or the hydrocarbon feed stream 12 if no hydrogen is provided with the hydrocarbon feed stream 12, enters the combined feed heat exchanger 30 at a temperature of generally about 38° C. to about 177° C. (about 100° F. to about 350° F.), and more usually about 93° C. to about 121° C. (about 200° F. to about 250° F.). Generally, the combined feed heat exchanger 30 heats the combined feed stream 26 by transferring heat from the product effluent 36 of the last reforming reaction zone in the reaction section 20 to the combined feed stream 26. An exemplary combined feed heat exchanger 30 is an indirect, rather than a direct, heat exchanger, in order to prevent valuable reformate product in the product effluent 36 from intermixing with the combined feed stream 26, and thereby being recycled to the reaction section 20, where the reformate quality could be degraded.

In an exemplary embodiment, the flow pattern of the combined feed stream 26 and the product effluent 36 within the combined feed heat exchanger 30 is countercurrent, through it could be completely co-current, reversed, mixed, or cross flow. In a countercurrent flow pattern, the combined feed stream 26, while at its coldest temperature, contacts one end (i.e., the cold end) of the heat exchange surface of the combined feed heat exchanger 30 while the product effluent 36 contacts the cold end of the heat exchange surface at its coldest temperature as well. Thus, the product effluent 36, while at its coldest temperature within the heat exchanger, exchanges heat with the combined feed stream that is also at its coldest temperature within the heat exchanger. At another end (i.e., the hot end) of the combined feed heat exchanger surface, the product effluent 36 and the combined feed stream, both at their hottest temperatures within the heat exchanger, contact the hot end of the heat exchange surface and thereby exchange heat. Between the cold and hot ends of the heat exchange surface, the product effluent 36 and the combined feed stream flow in generally opposite directions, so that, in general, at any point along the heat transfer surface, the hotter the temperature of the product effluent 36, the hotter is the temperature of the combined feed stream with which the product effluent 36 exchanges heat. The exemplary combined feed heat exchanger 30 operates with a hot end approach that is generally less than about 56° C. (about 100° F.), such as less than about 33° C. (about 60° F.), for example, less than about 28° C. (about 50° F.).

Although the combined feed heat exchanger 30 may utilize shell-and-tube type heat exchangers, it may alternatively use plate type heat exchangers. Plate type exchangers are well known and commercially available in several different and distinct forms, such as spiral, plate and frame, brazed-plate fin, and plate fin-and-tube types.

In one embodiment, the combined feed stream 26 leaves the combined feed heat exchanger 30 as a heated feed stream 40 at a temperature of about 399° C. to about 516° C. (about 750° F. to about 960° F.). Because the reforming reactions that occur first in the reaction zone 60 take place at an elevated temperature and are generally endothermic, the heated feed stream 40 often requires additional heating after exiting the combined feed heat exchanger 30 and prior to entering the reaction section 20.

In prior art apparatus, this additional heating is provided in a radiant cell such as a charge heater, for example, a gas-fired, oil-fired, or mixed gas-and-oil-fired heater, that heats the heated feed stream 40 by radiant or radiant and convective heat transfer. The heated feed stream 40 bypasses the radiant heating zone(s) and instead is heated in the convective heating section 18 without passing through a radiant heater.

In the convective heating section 18, the heated feed stream 40 flows through a convective heat bank 50 as described further in relation to FIG. 2 below. The heated feed stream 40 is typically heated to a temperature of about 427° C. to about 649° C. (about 800° F. to about 1,200° F.), or about 482° C. to about 593° C. (about 900° F. to about 1,100° F.), or about 510° C. to about 566° C. (about 950° F. to about 1,050° F.). As shown, the convectively heated stream 54 exits the convective heating section 18 and flows to the reaction section 20.

In some embodiments, the flue gas 51 (at a temperature of about 732° C. to about 899° C. (about 1350° F. to about 1650° F.)) flows from the convective heat bank 50 to a steam convection bank 52 where the flue gas is used to produce steam. The flue gas 53 exits the steam convection bank 52 at a temperature of about 149° C. to about 260° C. (about 300° F. to about 500° F.), and at least a portion 55 of the flue gas 53 is recycled to the convective heat bank 50. The recycled flue gas portion 55 may be compressed before being introduced into the convective heat bank 50. In other embodiments, the flue gas could be used in other heat recovery processes, or it could be recycled to the convective heat bank 50 without any additional heat recovery.

Alternatively, or in addition, a fresh gas stream 56 is introduced into the convective heat bank 50. The fresh gas stream 56 can be heated or cooled as needed, and it may also be compressed if desired. The inlet temperature for the fresh gas stream 56 can be about−12° C. to about 982° C. (about 10° F. to about 1800° F.)). Suitable gases include, but are not limited to, air, nitrogen, or another flue gas stream.

A temperature indicator/controller 58 is in communication with the convectively heated stream 54 upstream of the reaction section 20. The temperature indicator/controller 58 monitors the temperature of the convectively heated stream 54. When the temperature exceeds a predetermined maximum temperature, such as about 566° C. (1050° F.), or falls below a predetermined minimum temperature, such as about 510° C. (950° F.), the temperature indicator/controller 58 adjusts the amount of the recycled flue gas portion 55 and/or the amount and temperature of the fresh gas stream 56 entering the convective heat bank 50.

As shown, the convectively heated stream 54 enters the exemplary reaction section 20 which includes four reaction zones 60 through which hydrocarbons flow serially. Reaction sections having multiple reaction zones 60 generally take one of two forms: a stacked form as shown in FIG. 1 or a side-by-side form. In the side-by-side form, multiple and separate reaction vessels, each that can include a reaction zone, may be placed beside each other. In the stacked form, one common reaction vessel 62 contains multiple and separate reaction zones 60 that are placed on top of each other. In either arrangement, there can be intermediate heating or cooling between the reaction zones 60, depending on whether the reactions are endothermic or exothermic.

The exemplary catalytic reforming process utilizes a reaction section 20 with a first reaction zone 71, a second reaction zone 72, a third reaction zone 73, and a fourth reaction zone 74. There may be any number of reaction zones 60, but usually the number of reaction zones 60 is three, four or five. Hydrocarbons undergo conversion reactions in each reaction zone 60, in the presence of catalyst particles 76. The exemplary reforming process employs catalyst particles 76 in the reaction zones 60 in a series flow arrangement, and spent catalyst particles 78 may exit the reaction section 20 as shown.

In overview, the first reaction zone 71 receives the convectively heated stream 54 as a first reactor feed and produces a first reactor effluent 81. Endothermic reforming reactions that occur in the first reaction zone 71 generally cause the outlet temperature of the first reaction zone 71 to fall not only to less than the temperature of the convectively heated stream 54, but also to less than the desired inlet temperature of the second reaction zone 72. Therefore, the first reactor effluent 81 is heated in the radiant fired heating section 16 to the desired inlet temperature of the second reaction zone 72 as discussed below and is returned to the reaction section 20 as second reactor feed 82. The second reaction zone 72 reacts the second reactor feed 82 to form a second reactor effluent 83. Again, due to endothermic reactions, the second reactor effluent 83 requires heating to reach the desired inlet temperature of the third reaction zone 73. The second reactor effluent 83 flows to and is heated by the radiant fired heating section 16 as discussed below and is returned to the reaction section 20 as a third reactor feed 84. The third reaction zone 73 reacts the third reactor feed 84 to form a third reactor effluent 85. As above, endothermic reactions may cause the temperature of the third reactor effluent 85 to fall below the desired inlet temperature of the fourth reaction zone 74. The third reactor effluent 85 flows to and is heated by the radiant fired heating section 16 as discussed below and is returned to the reaction section 20 as a fourth reactor feed 86. The fourth reaction zone 74 reacts the fourth reactor feed 86 to form the product effluent 36.

Exemplary reaction zones 60 can be operated at reforming conditions, which include a range of pressures generally from atmospheric pressure of about 0 kPa(g) to about 6,895 kPa(g) (about 0 psig to about 1,000 psig), with particularly good results obtained at the relatively low pressure range of about 276 kPa(g) to about 1,379 kPa(g) (about 40 psig to about 200 psig). The overall liquid hourly space velocity (LHSV) based on the total catalyst volume in all of the reaction zones is generally about 0.1 $hr^{-1}$ to about 10 $hr^{-1}$, such as about 1 $hr^{-1}$ to about 5 $hr^{-1}$, for example, about 1.5 $hr^{-1}$ to about 2.0 $hr^{-1}$.

Generally naphthene reforming reactions that are endothermic occur in the first reaction zone 71, and thus the outlet temperature of the first reaction zone 71 can be less than the inlet temperature of the first reaction zone 71 and is generally about 316° C. to about 454° C. (about 600° F. to about 850° F.). The first reaction zone 71 may contain generally about 5% to about 50%, and more usually about 10% to about 30%, of the total catalyst volume in all of the reaction zones 60. Consequently, the liquid hourly space velocity (LHSV) in the first reaction zone 71, based on the catalyst volume in the first reaction zone 71, can be generally 0.2-200 $hr^{-1}$, such as about 2 $hr^{-1}$ to about 100 $hr^{-1}$, for example about 5 $hr^{-1}$ to about 20 $hr^{-1}$. Generally, the catalyst particles are withdrawn from the first reaction zone 71 and passed to the second reaction zone 72. The particles generally have a coke content of less than about 2 wt % based on the weight of catalyst.

An exemplary catalytic conversion process includes catalyst particles 76 that are movable through the reaction zones 60. The catalyst particles 76 may be movable through the reaction zones 60 by any number of motive devices, including conveyors or transport fluid, but most commonly the catalyst particles 76 are movable through the reaction zones 60 by gravity. Catalyst particles 76 can be withdrawn from a bottom portion of an upper reaction zone and introduced into a top portion of a lower reaction zone. The spent catalyst particles 78 withdrawn from the final reaction zone can subsequently be recovered from the process, regenerated in a regeneration zone (not shown) of the process, or transferred to another reaction zone 60. Likewise, the catalyst particles 76 added to a reaction zone can be catalyst that is being newly added to the process, catalyst that has been regenerated in a regeneration zone within the process, or catalyst that is transferred from another reaction zone 60.

Exemplary reforming reactions are normally effected in the presence of catalyst particles 76 comprised of one or more Group VIII (IUPAC 8-10) noble metals (e.g., platinum, iridium, rhodium, and palladium) and a halogen combined with a porous carrier, such as a refractory inorganic oxide. Although the catalyst may contain about 0.05 to about 2.0 wt % of Group VIII metal, a less expensive catalyst, such as a catalyst containing about 0.05 to about 0.5 wt % of Group VIII metal may be used. An exemplary noble metal is platinum. In addition, the catalyst may contain indium and/or a lanthanide series metal such as cerium. The catalyst particles 76 may also contain about 0.05 to about 0.5 wt % of one or more Group IVA (IUPAC 14) metals (e.g., tin, germanium, and lead). An exemplary halogen is chlorine and an exemplary carrier is alumina. Exemplary alumina materials are gamma, eta, and theta alumina, with gamma and eta alumina generally being used in selected embodiments.

A reforming process can employ a fixed catalyst bed, or a moving bed reaction vessel and a moving bed regeneration vessel. In the latter, generally regenerated catalyst particles 76 are fed to the reaction vessel 62, typically including several reaction zones 60, and the catalyst particles 76 flow through the reaction vessel 62 by gravity. During the course of a reforming reaction with a moving catalyst bed, catalyst particles become deactivated as a result of mechanisms such as the deposition of coke on the particles; that is, after a period of time in use, the ability of catalyst particles to promote reforming reactions decreases to the point that the catalyst is no longer useful. The catalyst can be reconditioned, or regenerated, before it is reused in a reforming process.

Specifically, catalyst may be withdrawn from the bottom of the reaction vessel 62 and transported to a regeneration vessel. In the regeneration vessel, a multi-step regeneration process is typically used to regenerate the catalyst to restore its full ability to promote reforming reactions. Catalyst can flow by gravity through the various regeneration steps and then be withdrawn from the regeneration vessel and transported to the reaction vessel 62. Generally, arrangements are provided for adding fresh catalyst as make-up to and for withdrawing spent catalyst particles 78 from the process. Movement of catalyst through the reaction and regeneration vessels is often referred to as continuous though, in practice, it is semi-continuous. In semi-continuous movement, relatively small amounts of catalyst are repeatedly transferred at closely spaced intervals. For example, one batch every twenty minutes may be withdrawn from the bottom of the reaction vessel 62 and withdrawal may take five minutes, that is, catalyst can flow for five minutes. If the catalyst inventory in a vessel is relatively large in comparison with this batch size, the catalyst bed in the vessel may be considered to be continuously moving. A moving bed system can have the advantage of maintaining production while the catalyst is removed or replaced. Typically, the rate of catalyst movement through the catalyst beds may range from as little as about 45.5 kg (about 100 pounds) per hour to about 2,722 kg (about 6,000 pounds) per hour, or more.

As shown in FIG. 1, downstream of the first reaction zone 71, hydrocarbons flow between the reaction zones 60 and radiant cells 90 in the radiant fired heating section 16. For example, the first reactor effluent 81 exits the reaction section 20 and flows into a first radiant cell 91 where it is heated and forms the second reactor feed 82. The second reactor effluent 83 exits the reaction section 20 and flows into a second radiant cell 92 where it is heated and forms the third reactor feed 84. Likewise, the third reactor effluent 85 exits the reaction section 20 and flows into a third radiant cell 93 where it is heated and forms the fourth reactor feed 86.

Effluent flow between reaction zones and radiant cells may typically occur with a flat temperature profile on the reaction zone inlets, i.e., heated effluent is the same temperature at all reaction zone inlets. Alternately, effluent flow may be managed with a graduated temperature profile. In either case, each radiant cell 90 (typically referred to as an interheater when it is located between two reaction zones 60) is heated by combustion of a fuel gas 94, selectively delivered to the radiant cell 90 by a valve 95 to heat the respective effluent to a same temperature.

As in the first reaction zone 71, endothermic reactions can cause another decline in temperature across the second reaction zone 72. Generally, however, the temperature decline across the second reaction zone 72 is less than the temperature decline across the first reaction zone 71, because the reactions that occur in the second reaction zone 72 are generally less endothermic than the reactions that occur in the first reaction zone 71. Despite the somewhat lower temperature decline across the second reaction zone 72, the second reactor effluent 83 is nevertheless still at a temperature that is less than the desired inlet temperature of the third reaction zone 73. Thus, the second effluent is heated in the second radiant cell 92 to form the third reactor feed 84.

The second reaction zone 72 generally includes about 10% to about 60%, and more usually about 15% to about 40%, of the total catalyst volume in all of the reaction zones 60. Consequently, the liquid hourly space velocity (LHSV) in the second reaction zone 72, based on the catalyst volume in the second reaction zone, is generally about 0.13 $hr^{-1}$ to about 134 $hr^{-1}$, such as about 1.3 $hr^{-1}$ to about 67 $hr^{-1}$, for example about 3.3 $hr^{-1}$ to about 13.4 $hr^{-1}$.

In the third reaction zone 73, endothermic reactions can cause another decline in temperature, though it is typically less than the temperature decline across the first reaction zone 71 as the reactions in the third reaction zone 73 are generally less endothermic. The third reaction zone 73 contains generally about 25% to about 75%, and more usually about 30% to about 50%, of the total catalyst volume in all of the reaction zones 60. In order to raise the temperature of the third reactor effluent 85, it is heated in the third radiant cell 93.

In an exemplary embodiment, each reactor effluent 81, 83, and 85 enters and exits the top portion of each radiant cell 91, 92, and 93 through U-shaped tubes. Alternatively, each reactor effluent 81, 83, 85 may enter and exit a lower portion of each radiant cell through inverted U-shaped tubes, or enter the top portion where the temperature is lowest in a radiant cell and exit at the bottom where the temperature is hottest in the radiant cell, or conversely, enter at the bottom and exit at the top. Of course, while U-shaped tubes are illustrated, there are many radiant cell coil configurations or layouts that can be utilized for radiant heating of the effluent.

After heating in the third radiant cell 93, the fourth reactor feed 86 is delivered to the fourth reaction zone 74. The fourth reaction zone 74 contains generally about 30% to about 80%, and more usually about 40% to about 50%, of the total catalyst volume in all of the reaction zones 60. The inlet temperatures of the third, fourth, and subsequent reaction zones are generally about 482° C. to about 560° C. (about 900° F. to about 1,040° F.), such as about 493° C. to about 549° C. (about 920° F. to about 1,020° F.).

Because the reforming reactions that occur in the second and subsequent (i.e., third and fourth) reaction zones 60 are generally less endothermic than those that occur in the first reaction zone 71, the temperature drop that occurs in the later reaction zones 60 is generally less than that that occurs in the first reaction zone 71. Thus, the outlet temperature of the last reaction zone 74 may be about 11° C. (about 20° F.) or less below the inlet temperature of the last reaction zone 74, and indeed may conceivably be higher than the inlet temperature of the last reaction zone 74. Moreover, any inlet temperature profiles can be utilized with the above-described reaction zones 60. The inlet temperature profiles can be flat or skewed, such as ascending, descending, hill-shaped, or valley-shaped. Desirably, the inlet temperature profile of the reaction zones 60 is flat.

As shown, the product effluent 36 is cooled in the combined feed heat exchanger 30 by transferring heat to the combined feed stream 26. After leaving the combined feed heat exchanger 30, the cooled product effluent 96 passes to the product recovery section 22. Suitable product recovery sections 22 are well-known. The exemplary product recovery section 22 may include a gas-liquid separator for separating hydrogen and $C_1$-$C_3$ hydrocarbon gases from the product effluent 36, and fractionation columns for separating at least a portion of the $C_4$-$C_5$ light hydrocarbons from the remainder of the reformate. In addition, the reformate may be separated by distillation into a light reformate fraction and a heavy reformate fraction. As a result of product recovery processes, a product stream 98 is formed, or multiple product streams 98 are formed, containing desired species.

Figure 2:
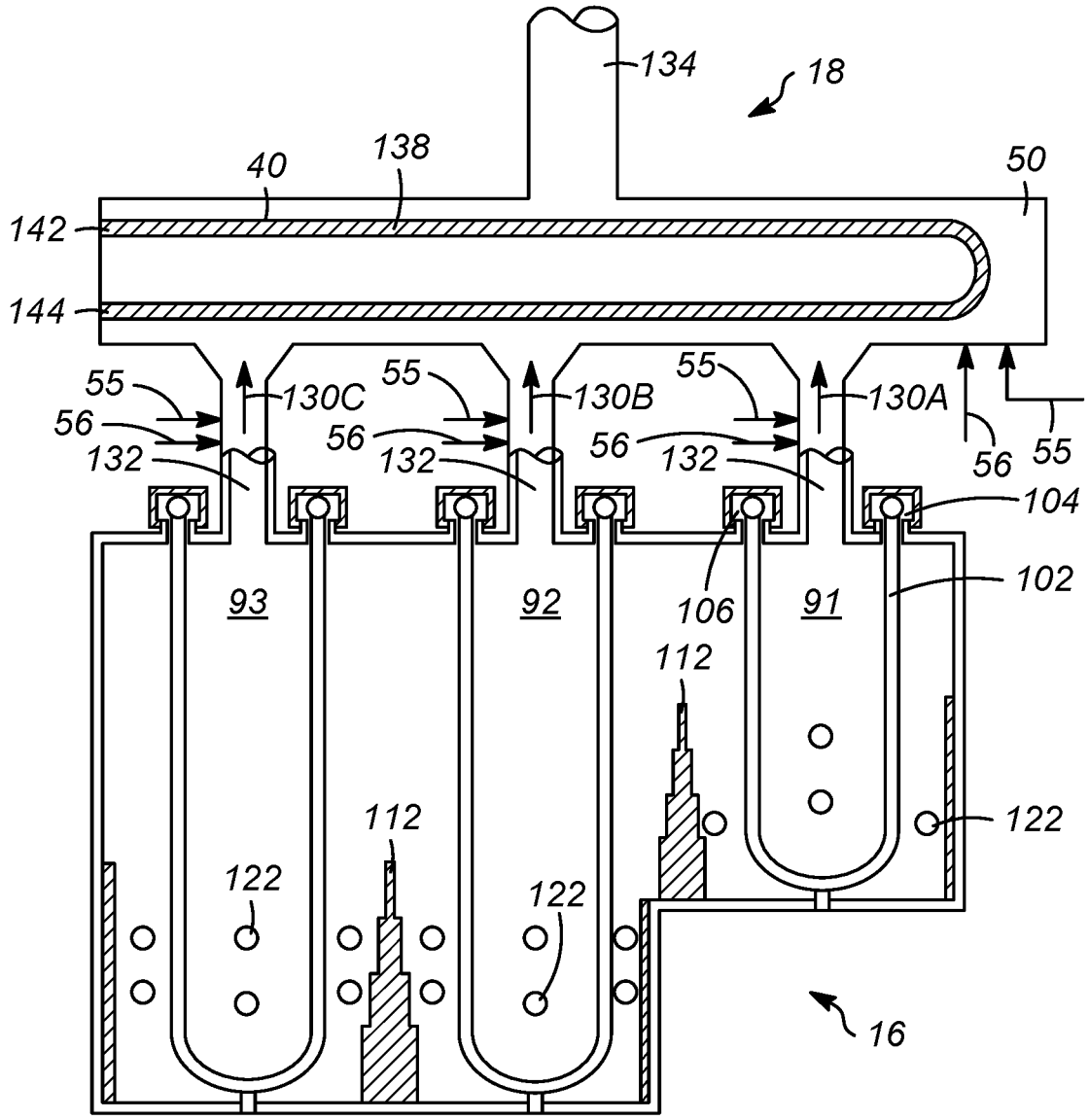
FIG. 2 is an illustration of the flow of exhaust gases and the additional gases used to control the heated feed stream outlet temperature from the convective bank.

Referring now to FIG. 2, heat transfer between the radiant fired heating section 16 and the convective heating section 18 is explained. As shown, each radiant cell 91, 92, 93 includes a radiant tube 102 having an inlet 104 and an outlet 106, and may be somewhat U-shaped and orientated upwardly. Although only one radiant tube is illustrated for each radiant cell 91, 92, 93, it should be understood that generally each radiant cell 91, 92, 93 can include an inlet manifold, a series of tubes, and an outlet manifold. A series of radiant tubes 102 may be configured in a parallel configuration and can be stacked front-to-back. The radiant cells 91, 92, 93 can be separated by firewalls 112 and include, respectively, at least one burner 122.

As effluent streams pass through each respective radiant cell 90, fuel gas 94 is combusted in the burner 122 and forms flue gas 130A-C. The flue gas 130A-C rising from the radiant cells 91, 92, 93 can enter the convective heat bank 50 in the convective heating section 18 through an inlet or inlets 132 and exit through a stack 134. The convective heat bank 50 generally includes several convective tubes 138 in a parallel configuration. Each convective tube 138 has an inlet 142 and an outlet 144 and can be somewhat U-shaped and oriented sideways. For a plurality of convective tubes 138, convective tubes 138 can be stacked front-to-back in rows. Although convective tubes 138 can be oriented beside one another, it should be understood that other orientations are possible, such as orienting the U-shaped tubes flat and stacking several convective tubes 138 vertically in rows.

The heated feed stream 40 entering the convective heating section 18 enters the inlet 142 of the convective tube 138 and is convectively heated by thermal transfer from the flue gas 130A-C through the convective tube 138. While the inlet 142 is indicated as being above the outlet 144 such that the heated feed stream 40 enters the top portion where the temperature is lowest in the convective heating section 18 and exits at the bottom where the temperature is hottest in the convective heating section 18 through the sideways-oriented U-shaped convective tubes 138, other configurations are contemplated. For example, the heated feed stream 40 may enter and exit the top or lower portion of the convective heat bank 50, or enter at the bottom and exit at the top.

The recycled flue gas portion 55 and/or the fresh gas stream 56 are used to control the temperature of the convectively heated stream 54. By adjusting (increasing or decreasing) the temperature or the amount or both of recycled flue gas portion 55 and/or the fresh gas stream 56, the temperature of the convectively heated stream 54 can be controlled. The recycled flue gas portion 55 and/or the fresh gas stream 56 may be introduced into the convective heat bank 50 separately, or they can be combined first, if desired. They can be introduced directly into the convective heat bank 50, if desired. Alternatively, or in addition, either or both can be introduced into the flue gas 130A-C between the radiant cell 91, 92, 93 outlet and the inlet to the convective heat bank 50 in one or more of the radiant cells 91, 92, 93.

As used herein, the term about means within 10% of the value, or within 5%, or within 1%.

As described herein, an apparatus and method for heating a hydrocarbon stream for processing have been provided. In exemplary embodiments, an apparatus and method have been described for catalytic reforming processes, though any suitable apparatus and methods for processing hydrocarbons may utilize the heating process discloses herein. Although the embodiments discussed above can be designed for a new hydrocarbon processing apparatus, it should be understood that the disclosed features can implemented during the revamp of an existing apparatus.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the claimed subject matter in any way. Rather, the foregoing detailed description will provide those skilled in the art with a convenient road map for implementing an exemplary embodiment or embodiments. It being understood that various changes may be made in the function and arrangement of elements described in an exemplary embodiment without departing from the scope set forth in the appended claims.

SPECIFIC EMBODIMENTS

While the following is described in conjunction with specific embodiments, it will be understood that this description is intended to illustrate and not limit the scope of the preceding description and the appended claims.

A first embodiment of the invention is a method for processing a hydrocarbon stream, the method comprising heating a feed stream in a convective bank; reacting the heated feed stream in a first reaction zone to form a first effluent; heating the first effluent in a first radiant cell, wherein the first radiant cell combusts fuel to heat the first effluent and forms a first exhaust gas; contacting the first exhaust gas with the convective bank to heat the feed stream; and controlling an outlet temperature of the heated feed stream from the convective bank by introducing an additional gas stream into the convective bank. An embodiment of the invention is one, any or all of prior embodiments in this paragraph up through the first embodiment in this paragraph wherein the additional gas stream comprises a fresh gas, a recycled portion of the first exhaust gas, or a combination thereof. An embodiment of the invention is one, any or all of prior embodiments in this paragraph up through the first embodiment in this paragraph where the additional gas stream comprises the fresh gas, and wherein a temperature of the fresh gas or an amount of the fresh gas, or both is adjusted based on the outlet temperature of the heated feed stream. An embodiment of the invention is one, any or all of prior embodiments in this paragraph up through the first embodiment in this paragraph wherein the temperature of the fresh gas is increased. An embodiment of the invention is one, any or all of prior embodiments in this paragraph up through the first embodiment in this paragraph where the additional gas stream comprises the fresh gas, and wherein a temperature of the fresh gas is in a range of about−12° C. to about 982° C. An embodiment of the invention is one, any or all of prior embodiments in this paragraph up through the first embodiment in this paragraph where the additional gas stream comprises the fresh gas, and wherein the fresh gas is compressed. An embodiment of the invention is one, any or all of prior embodiments in this paragraph up through the first embodiment in this paragraph where the additional gas stream comprises the recycled portion of the first exhaust gas, and wherein the recycled portion of the first exhaust gas is compressed before being introduced into the convective bank. An embodiment of the invention is one, any or all of prior embodiments in this paragraph up through the first embodiment in this paragraph where the additional gas stream comprises the recycled portion of the first exhaust gas, and wherein a temperature of the recycled portion of the first exhaust gas is in a range of about 149° C. to about 260° C. An embodiment of the invention is one, any or all of prior embodiments in this paragraph up through the first embodiment in this paragraph where the additional gas stream comprises the recycled portion of the first exhaust gas, and wherein a temperature of the recycled portion of the first exhaust gas or an amount of the recycled portion of the first exhaust gas, or both is adjusted based on the outlet temperature of the heated feed stream. An embodiment of the invention is one, any or all of prior embodiments in this paragraph up through the first embodiment in this paragraph wherein controlling the outlet temperature of the heated feed stream from the convective bank comprises monitoring the outlet temperature of the heated feed stream; and adjusting an amount of the additional gas stream introduced into the convective bank, or adjusting a temperature of the additional gas stream introduced into the convective bank, or both based on the outlet temperature of the heated feed stream. An embodiment of the invention is one, any or all of prior embodiments in this paragraph up through the first embodiment in this paragraph wherein a temperature of the additional gas stream is in a range of about 149° C. to about 260° C. An embodiment of the invention is one, any or all of prior embodiments in this paragraph up through the first embodiment in this paragraph further comprising reacting the heated first effluent in a second reaction zone to form a second effluent; heating the second effluent in a second radiant cell, wherein the second radiant cell combusts fuel to radiantly heat the second effluent and the combusted fuel forms a second exhaust gas; contacting the second exhaust gas with the convective bank to heat the feed stream; reacting the heated second effluent in a third reaction zone to form a third effluent; heating the third effluent in a third radiant cell, wherein the third radiant cell combusts fuel to radiantly heat the third effluent and the combusted fuel forms a third exhaust gas; contacting the third exhaust gas with the convective bank to heat the feed stream; and reacting the heated third effluent in a fourth reaction zone to form a product effluent. An embodiment of the invention is one, any or all of prior embodiments in this paragraph up through the first embodiment in this paragraph further comprising passing the product effluent through a heat exchanger; and heating the feed stream in the heat exchanger before heating the feed stream in the convective bank. An embodiment of the invention is one, any or all of prior embodiments in this paragraph up through the first embodiment in this paragraph further comprising condensing the product effluent to form a product stream. An embodiment of the invention is one, any or all of prior embodiments in this paragraph up through the first embodiment in this paragraph further comprising adding a gas stream comprising hydrogen to the feed stream before heating the feed stream in the convective bank.

A second embodiment of the invention is a method for processing a hydrocarbon stream, the method comprising heating a feed stream in a convective bank; reacting the heated feed stream in a first reaction zone to form a first effluent; heating the first effluent in a first radiant cell, wherein the first radiant cell combusts fuel to heat the first effluent and forms a first exhaust gas; contacting the first exhaust gas with the convective bank to heat the feed stream; monitoring an outlet temperature of the heated feed stream from the convective bank; and controlling the outlet temperature of the heated feed stream by introducing an additional gas stream into the convective bank, wherein the additional gas stream comprises a fresh gas, a recycled portion of the first exhaust gas, or a combination thereof. An embodiment of the invention is one, any or all of prior embodiments in this paragraph up through the second embodiment in this paragraph wherein the additional gas stream comprises the fresh gas, and wherein a temperature of the fresh gas or an amount of the fresh gas, or both is adjusted based on the outlet temperature of the heated feed stream; or where the additional gas stream comprises the recycled portion of the first exhaust gas, and wherein the recycled portion of the first exhaust gas or an amount of the recycled portion of the first exhaust gas, or both is adjusted based on the outlet temperature of the heated feed stream. An embodiment of the invention is one, any or all of prior embodiments in this paragraph up through the second embodiment in this paragraph further comprising reacting the heated first effluent in a second reaction zone to form a second effluent; heating the second effluent in a second radiant cell, wherein the second radiant cell combusts fuel to radiantly heat the second effluent and the combusted fuel forms a second exhaust gas; contacting the second exhaust gas with the convective bank to heat the feed stream; reacting the second effluent in a third reaction zone to form a third effluent; heating the third effluent in a third radiant cell, wherein the third radiant cell combusts fuel to heat the third effluent and the combusted fuel forms a third exhaust gas; contacting the third exhaust gas with the convective bank to heat the feed stream; and reacting the third effluent in a fourth reaction zone to form a product effluent. An embodiment of the invention is one, any or all of prior embodiments in this paragraph up through the second embodiment in this paragraph further comprising passing the product effluent through a heat exchanger; and heating the feed stream in the heat exchanger before heating the feed stream in the convective bank.

A third embodiment of the invention is an apparatus for processing a hydrocarbon stream, the apparatus comprising a heat exchanger configured to heat a feed stream; a convective bank configured to receive the heated feed stream and an additional gas stream; a reaction zone configured to receive a heated feed stream from the convective bank and to react the heated feed stream to form an effluent; a radiant cell configured to receive and heat the effluent, wherein the radiant cell forms an exhaust gas, and wherein the radiant cell is configured to pass a portion of the exhaust gas to the convective bank to heat the feed stream; a temperature sensor configured to monitor a temperature of the heated feed stream exiting the convective bank; and a flow controller configured to change an amount of the additional gas flowing to the convective bank in response to the temperature of the heated feed stream exiting the convective bank.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A method for processing a hydrocarbon stream in a reformer, the method comprising:

heating a naphtha feed stream in a convective bank, the convective bank in fluid and thermal communication with at least one radiant cell, wherein the entire naphtha feed stream is heated in the convective bank without passing through the at least one radiant cell or another radiant heater before reaching the convective bank;

reacting the heated naphtha feed stream in a first reformer reaction zone to form a first reformer effluent;

heating the first reformer effluent in a first radiant cell, wherein the first radiant cell combusts fuel to heat the first reformer effluent and forms a first flue gas;

introducing the first flue gas from the first radiant cell into the convective bank to heat the naphtha feed stream;

removing an exhaust gas from the convective bank at a temperature in a range of about 732° C. to about 899° C.; and controlling an outlet temperature of the heated naphtha feed stream from the convective bank to a temperature in a range of about 427° C. to about 649° C. by introducing an additional gas stream into the convective bank so that the additional gas stream mixes with the flue gas to maintain a temperature in the convective bank in a range of about 732° C. to about 899° C., wherein the additional gas stream comprises a fresh gas at a temperature in a range of −12° C. to about 982° C., a recycled portion of the exhaust gas at a temperature in a range of about 149° C. to about 260° C., or a combination thereof, and wherein the fresh gas does not comprise steam.

2. The method of claim 1 where the additional gas stream comprises the fresh gas, and wherein a temperature of the fresh gas or an amount of the fresh gas, or both is adjusted based on the outlet temperature of the heated feed stream.

3. The method of claim 2 wherein the temperature of the fresh gas is increased.

4. The method of claim 1 where the additional gas stream comprises the fresh gas.

5. The method of claim 1 where the additional gas stream comprises the fresh gas, and wherein the fresh gas is compressed.

6. The method of claim 1 where the additional gas stream comprises the recycled portion of the exhaust gas, and wherein the recycled portion of the exhaust gas is compressed before being introduced into the convective bank.

7. The method of claim 1 where the additional gas stream comprises the recycled portion of the exhaust gas.

8. The method of claim 1 where the additional gas stream comprises the recycled portion of the exhaust gas, and wherein a temperature of the recycled portion of the exhaust gas or an amount of the recycled portion of the exhaust gas, or both is adjusted based on the outlet temperature of the heated naphtha feed stream.

9. The method of claim 1 wherein controlling the outlet temperature of the heated feed stream from the convective bank comprises:

monitoring the outlet temperature of the heated naphtha feed stream; and adjusting an amount of the additional gas stream introduced into the convective bank, or adjusting a temperature of the additional gas stream introduced into the convective bank, or both based on the outlet temperature of the heated naphtha feed stream.

10. The method of claim 1 further comprising:

reacting the heated first reformer effluent in a second reformer reaction zone to form a second reformer effluent;

heating the second reformer effluent in a second radiant cell, wherein the second radiant cell combusts fuel to radiantly heat the second reformer effluent and the combusted fuel forms a second flue gas;

introducing the second flue gas from the second radiant cell into the convective bank so that the second flue gas mixes with the flue gas to heat the naphtha feed stream;

reacting the heated second reformer effluent in a third reformer reaction zone to form a third reformer effluent;

heating the third reformer effluent in a third radiant cell, wherein the third radiant cell combusts fuel to radiantly heat the third reformer effluent and the combusted fuel forms a third flue gas;

introducing the third flue gas from the third radiant cell into the convective bank so that the third flue gas mixes with the flue gas to heat the naphtha feed stream; and reacting the heated third reformer effluent in a fourth reformer reaction zone to form a product effluent.

11. The method of claim 10 further comprising:

passing the naphtha feed stream and the product effluent through a heat exchanger before heating the naphtha feed stream in the convective bank to preheat the naphtha feed stream.

12. The method of claim 10 further comprising condensing the product effluent to form a product stream.

13. The method of claim 1 further comprising adding a gas stream comprising hydrogen to the naphtha feed stream before heating the naphtha feed stream in the convective bank.

14. A method for processing a hydrocarbon stream in a reformer, the method comprising:

heating a naphtha feed stream in a convective bank, the convective bank in fluid and thermal communication with at least one radiant cell, wherein the entire naphtha feed stream is heated in the convective bank without passing through the at least one radiant cell or another radiant heater before reaching the convective bank;

reacting the heated naphtha feed stream in a first reformer reaction zone to form a first reformer effluent;

heating the first reformer effluent in a first radiant cell, wherein the first radiant cell combusts fuel to heat the first reformer effluent and forms a first flue gas;

introducing the first flue gas from the first radiant cell into the convective bank to heat the naphtha feed stream;

removing an exhaust gas from the convective bank, the exhaust gas having a temperature in a range of about 732° C. to about 899° C.;

monitoring an outlet temperature of the heated naphtha feed stream from the convective bank; and controlling the outlet temperature of the heated naphtha feed stream to a temperature in a range of about 427° C. to about 649° C. by introducing an additional gas stream into the convective bank so that the additional gas stream mixes with the first flue gas, and adjusting an amount of the additional gas, or adjusting a temperature of the additional gas, or both in response to the outlet temperature of the heated naphtha stream to maintain a temperature in the convective bank in a range of about 732° C. to about 899° C., wherein the additional gas stream comprises a fresh gas, a recycled portion of the exhaust gas, or a combination thereof, wherein the fresh gas is at a temperature in a range of −12° C. to about 982° C., and wherein the recycled portion of the first exhaust gas is at a temperature in a range of about 149° C. to about 260° C., and wherein the fresh gas does not comprise steam.

15. The method of claim 14 wherein the additional gas stream is compressed.

16. The method of claim 14 further comprising:

reacting the heated first reformer effluent in a second reformer reaction zone to form a second reformer effluent;

heating the second reformer effluent in a second radiant cell, wherein the second radiant cell combusts fuel to radiantly heat the second reformer effluent and the combusted fuel forms a second flue gas;

introducing the second flue gas from the second radiant cell into the convective bank so that the second flue gas mixes with the first flue gas to heat the naphtha feed stream;

reacting the second reformer effluent in a third reformer reaction zone to form a third reformer effluent;

heating the third reformer effluent in a third radiant cell, wherein the third radiant cell combusts fuel to heat the third reformer effluent and the combusted fuel forms a third flue gas;

introducing the third flue gas from the third radiant cell into the convective bank so that the third flue gas mixes with the first flue gas to heat the naphtha feed stream; and reacting the third reformer effluent in a fourth reformer reaction zone to form a product effluent.

17. The method of claim 14 further comprising:

passing the naphtha feed stream and the product effluent through a heat exchanger before heating the naphtha feed stream in the convective bank to preheat the naphtha feed stream.

18. The method of claim 1 wherein the additional gas stream comprises the recycled portion of the exhaust gas, and further comprising:

introducing the exhaust gas into a steam convection bank to produce steam and the recycled portion of the exhaust gas; and introducing the recycled portion of the exhaust gas into the convective bank.

19. The method of claim 14 wherein the additional gas stream comprises the recycled portion of the exhaust gas, and further comprising:

introducing the exhaust gas into a steam convection bank to produce steam and the recycled portion of the exhaust gas; and introducing the recycled portion of the exhaust gas into the convective bank.

* * * * *